United States Patent [19]

May et al.

[11] Patent Number: 4,736,533

[45] Date of Patent: Apr. 12, 1988

[54] INTERIORLY LOCATED, ROTATING, SELF SHARPENING REPLACEABLE DIGGING TOOTH APPARATUS AND METHOD

[76] Inventors: Charles R. May, Rte. 4, Box 4751, Belton, Tex. 76513; Michael E. Tubbs, Rte. 3, Box 3458, Salado, Tex. 76571

[21] Appl. No.: 879,035

[22] Filed: Jun. 26, 1986

[51] Int. Cl.[4] ..... E02F 5/00

[52] U.S. Cl. ..... 37/141 T; 299/86

[58] Field of Search ..... 37/141 R, 141 T, 142 R, 37/142 A; 299/84, 86, 90–92

[56] References Cited

U.S. PATENT DOCUMENTS

| | | | |
|---|---|---|---|
| 2,050,014 | 8/1936 | Morrison | 37/142 R |
| 3,444,633 | 5/1969 | Hensley | 37/142 R |
| 3,499,685 | 3/1970 | Kniff | 299/92 X |
| 3,512,838 | 5/1970 | Kniff | 299/86 |
| 3,623,247 | 11/1971 | Stepe | 37/142 R |
| 3,851,413 | 12/1974 | Lukavich | 37/142 R X |
| 3,870,370 | 3/1975 | Winberg et al. | 37/142 R |
| 4,163,581 | 8/1979 | Krekeler | 37/142 R |
| 4,234,233 | 11/1980 | Hurd et al. | 299/84 |
| 4,319,415 | 3/1982 | Mayerbock et al. | 37/141 T |
| 4,343,516 | 8/1982 | Aden | 299/86 |
| 4,414,764 | 11/1983 | Johansson et al. | 37/141 T |
| 4,415,208 | 11/1983 | Goyarts | 299/86 |
| 4,484,783 | 11/1984 | Emmerich | 299/86 |
| 4,575,156 | 3/1986 | Hunter et al. | 37/142 R |

FOREIGN PATENT DOCUMENTS

| | | | |
|---|---|---|---|
| 2419264 | 11/1974 | Fed. Rep. of Germany | 299/91 |
| 2627481 | 12/1977 | Fed. Rep. of Germany | 299/86 |
| 2032495 | 5/1980 | United Kingdom | 299/91 |
| 2159196 | 11/1985 | United Kingdom | 299/91 |

*Primary Examiner*—E. Eickholt

*Attorney, Agent, or Firm*—John Nevin Shaffer, Jr.

[57] ABSTRACT

An interiorly located, rotating, self sharpening, replaceable digging tooth device having a removeable cap that fits over and is attached to a shank on an excavating machine, a replaceable digging tooth mounted within one end of the cap and a female socket in the cap for receiving and retaining the tooth and allowing it to rotate therein so that the tooth is self sharpening. The removeable cap is conformable to any sized shank on any excavating machine and has a front portion that is primarily solid within which the digging tooth is inserted. As a result, the digging tooth, much like a human tooth, is much better able to resist shear forces applied to it. More than one digging tooth may be provided per cap and as many caps may be provided as there are shanks on an excavating machine.

9 Claims, 3 Drawing Sheets

INTERIORLY LOCATED, ROTATING, SELF SHARPENING REPLACEABLE DIGGING TOOTH APPARATUS AND METHOD

BACKGROUND OF THE INVENTION

This invention relates to an improved interiorly located, rotating, self sharpening, replaceable digging tooth apparatus and method.

The provision of digging teeth on large earth movers has been known in the art for quite some time. For example, a box type cap to be placed over shanks on an excavating bucket has been designed that provides a wedged shaped digging tooth for excavation. An example of such a tooth is disclosed in Morrison, U.S. Pat. No. 2,050,014. Other examples, such as Hensley, U.S. Pat. No. 3,444,633, and Stepe, U.S. Pat. No. 3,623,247, also disclose coverings for shanks of excavating buckets with tooth-like devices. The supposed improvements of these devices were in the nature of forming a tight fit with the shank so that the tooth would not work its way off of the shank once placed in position. Other patents have been issued which address the problem of replacement of these teeth, that are highly subject to wear, by various "quick change" means such as disclosed in Lukavich U.S. Pat. No. 3,851,413 and Johansson et al. U.S. Pat. No. 4,414,764. Further, at least one patent, Hemphill, U.S. Pat. No. 4,098,013, was issued for a "digging tooth with replaceable cutting edge". This invention addressed the problem of maintaining a sharp digging edge by means of providing a replaceable "nose piece" that was placed over the digging tooth for a backhoe bucket and which could be replaced whenever the cutting edge thereon became worn.

In today's construction industry, most dirt, rock, sand, etc., is excavated by backhoes, trackhoes and rippers. To dig a ditch for underground utilities or excavate for a highrise foundation, for instance, some sort of excavator or ripper is used. These excavators and rippers are made world wide and are composed generally of a frame, motor, tires or tracks, extended arm, hydraulic system to transfer power from the motor to the arm and a mounting device so that something can be attached to the end of the hydraulic powered arm to scoop up and hold the material. Normally, a "bucket" is mounted to the arm. Buckets come in various shapes and sizes. Narrow buckets are used to dig a narrow utility ditch, for instance, and wide and deep buckets are used to excavate large volumns of materials for a pit or a large foundation area.

On the cutting edge of the bucket are "shanks". Shanks are usually welded and permanently attached to the bucket and are used as a mount for "teeth". Teeth are mounted to the shanks and have sharp edges that are supposed to cut through material to be excavated and are designed to be replaceable when worn out. In fact, digging teeth of prior art design wear out at a rapid and costly rate. The reason for this is that in order to dig anything except soft, loose material, that is, in order to dig any type of hard material such as rock, a pointed tooth must be present on the bucket. A drawback with the digging teeth known in the art is that, although some, but not all, teeth are pointed, the points or edges do not hold up long in any kind of hard, abrasive soil or rock digging. Typically, the rock work dulls teeth very quickly and the edge of present devices is lost which results in lost production time while the machine is stopped in order to change and replace dulled teeth. A further drawback with digging teeth known in the art is that, in order to prevent the point from being broken off, the devices are designed so that the stress of digging runs away from the point to the sides rather than to the larger, stronger central body of the tooth. Additionally present designs cause wear and fatigue of the tooth and its mating surface so that often these teeth fall off their mount. A still further drawback of the digging teeth known in the art is that, because of the fact that these teeth wear out so quickly, digging machines must be shut down and considerable time spent to replace worn teeth which results in a major reoccuring expense and repeated production loss over short periods of time. The fact that the digging teeth will not hold up to abrasive conditions, while all the rest of the machine will, is therefore very costly to the equipment owner.

Thus, there is a need in the art for providing a digging tooth that presents a constantly sharp point to the material being excavated, that can bear the stress of digging hard material without weakening its attachment and which is easily replaceable when necessary. It, therefore, is an object of this invention to provide an improved digging tooth that is self sharpening so that the life of each individual tooth is considerably prolonged. It is a further object of this invention to provide a digging tooth that is interiorly located in a secured position within a driving mechanism with much of the same advantages that a human tooth has over a cap. It is a further object of this invention to provide a digging tooth that can rotate within its interiorly located position so that much of the stress of cutting is avoided and so that the rotation enhances and assists the self sharpening of the tooth while in use. Yet another object of this invention is to provide a digging tooth that, when necessary, is extremely easy to replace, so that the absolute minimum amount of down time to the working machine results from the replacement process.

SHORT STATEMENT OF THE INVENTION

Accordingly, the digging tooth of the present invention includes a replaceably, removeable cap means that fits over and that is attached to a shank on an ordinary excavating machine. A replaceable bullet shaped, cylindrical, tooth is mounted within the exposed end of the cap. A female socket is designed in shape to conform to the dimensions of the bullet shaped tooth and is drilled out of the material composing the solid exposed end of the removeable cap. The bullet shaped digging tooth has at its base a ring of ball bearings, or some other friction reducing means, that are held in position around the base in an inner race and in which the bearing faces are extended somewhat beyond the dimensions of the cylindrically shaped tooth. The female socket has a corresponding outer race channel that matches the inner race retaining mechanism on the base of the digging tooth so that the ball bearings just fit into this outer race and are retained therein. As a result, the tooth, once in place in the socket, is free to revolve within that socket.

Additionally, the digging tooth is composed of a hard outer shell with a harder inner core that forms the point of the digging tooth. As a result, as the digging tooth is utilized the hard outer core is worn away and the harder inner point remains. As the tooth is rotated through use, the tooth is constantly resharpened. As a result, the utility and the wear life of the tooth is extended considerably.

A channel around the upper portion of the digging tooth just above the face of the cap is provided so that any forked tool, such as pliers or a crowbar, can be used to pull a worn tooth from the socket. Also, there is a hole in the bottom of the socket connecting the socket with the hollow portion of the cap which covers the shank. As a result, should a tooth break off within the socket, the entire cap may be removed from the shank and through use of the connecting hole, the digging tooth can be pushed from the socket so that a new tooth may be inserted. The digging tooth of this invention may be used singularly or may be designed for use with a cap that contains several such teeth.

BREIF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

The preferred embodiment of the present invention is illustrated by way of example in FIGS. 1-9. With specific reference to FIG. 1, digging device 10 includes removeable cap means 12 and digging tooth 14.

Figure 1:
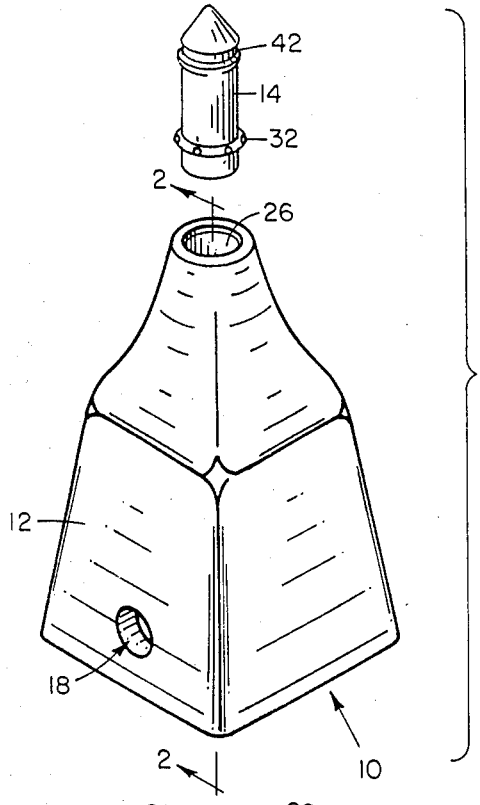
FIG. 1 is a side perspective view of a preferred embodiment of the digging tooth of the present invention with the digging tooth withdrawn from the female socket.
Figure 2:
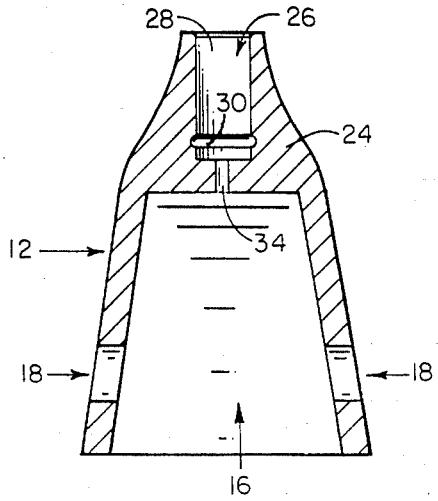
FIG. 2 is a cross section of the cap means taken along lines 2—2 of FIG. 1.

FIG. 2 is a cross sectional view of removeable cap means 12 taken along lines 2—2 of FIG. 1. This cross sectional view illustrates that cap means 12 has a lower half with a substantially hollow portion 16 that is designed to conform with the shank means on any earth moving equipment being used. That is to say, substantially hollow portion 16 can be prepared to conform to any shank for any system.

Figure 2A:
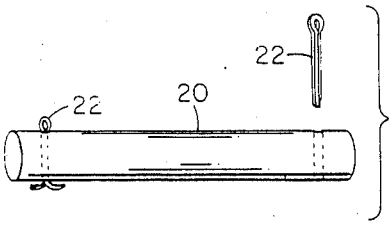
FIG. 2A is a side view of the retaining pin and octter pins.

Oppositely positioned retaining holes 18 are provided near the base of the substantially hollow portion 16. These retaining holes 18 are conformed to match similar retaining holes in the shank of the digging device being utilized. Obviously, retaining holes 18 could be modified in any way necessary so that the means for attaching removeable cap means 12 to an available shank would match. By way of further illustration, FIG. 2A shows retaining pin 20 which conforms to match retaining holes 18. In use, retaining pin 20 would be passed through retaining holes 18 after removeable cap 12 was placed over the shank on the excavating bucket, not shown. Once inserted, retaining pin 20 would be held in place by a pair of cotter pins 22 which pass through retaining pin 20 and hold retaining pin 20 in place within retaining holes 18 so that removeable cap 12 will not accidentally or inadvertently fall off of the shank of the excavating bucket.

FIG. 2 further illustrates the removeable cap means 12 by showing a substantially solid portion 24 that provides a base and support for female socket receiving means 26. Female socket receiving means 26 is composed of a cylindrically shaped chamber 28 conformed so as just to receive digging tooth 14. Cylindrically shaped chamber 28 has an outer race channel 30 near the bottom of chamber 28 conformed to receive inner race means 32 on digging tooth 14, shown in FIG. 1.

FIG. 2 further illustrates ejection hole 34 that connects cylindrically shaped chamber 28 with the substantially hollow portion 16 of cap means 12.

Figure 3:
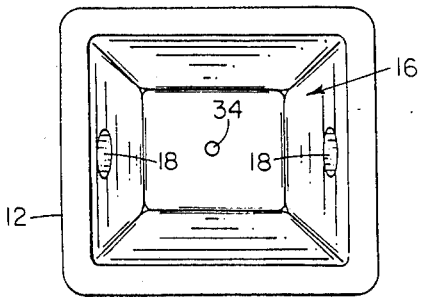
FIG. 3 is a bottom view of the cap means.

Referring to FIG. 3, removeable cap means 12 is shown in a bottom view.

Figure 4:
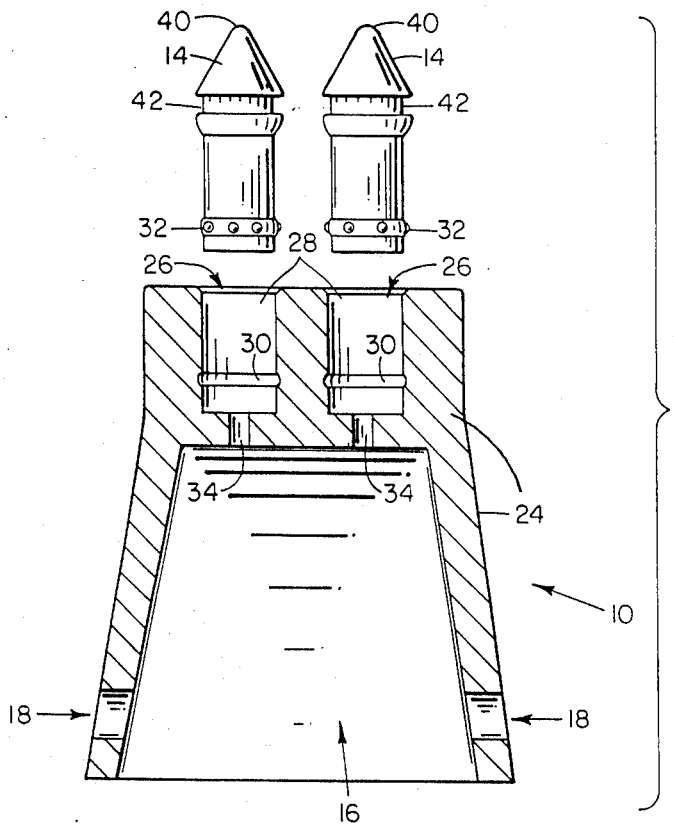
FIG. 4 is a cross sectional view, as in FIG. 2, of the cap means wherein more than one socket is illustrated and more than one digging tooth is represented.

FIG. 4 illustrates device 10 by showing removeable cap means 12 in cross section. As shown in FIG. 4, substantially solid portion 24 is shown as providing a base and support for more than one digging tooth 14. The device 10 is unchanged other than to provide for a plurality of digging teeth 14.

Figure 5:
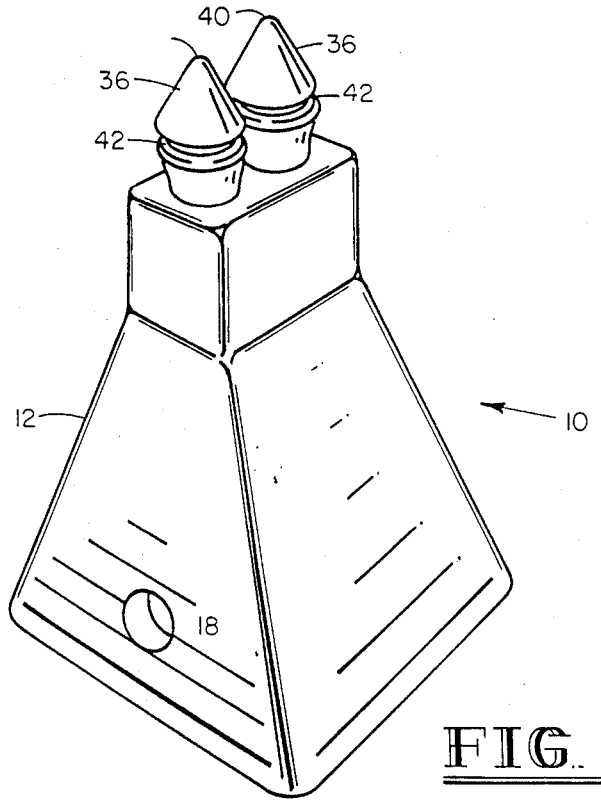
FIG. 5 is a perspective view of a cap means adapted to receive more than one digging tooth with two digging teeth in place.

FIG. 5 is a plan view of digging device 10 with two digging teeth 14 in place wherein removeable cap means 12 is designed to provide support for more than one digging tooth 14.

Figure 6:
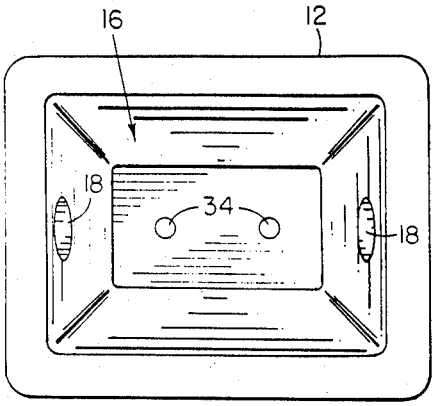
FIG. 6 is a bottom view of the cap means adapted to receive more than one digging tooth.
Figure 7:
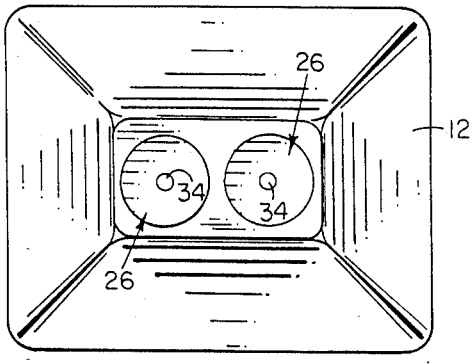
FIG. 7 is a top view of a cap means designed to receive more than one digging tooth.

FIG. 6 is a bottom view of digging device 10 wherein removeable cap means 12 is conformed to provide for more than one digging tooth 14. FIG. 7 is a top view of such an embodiment.

Figure 8:
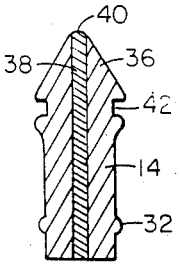
FIG. 8 is a cross sectional view of the digging tooth.

FIG. 8 is a cross sectional view of digging tooth 14. This cross sectional view illustrates the hard outer shell 36 that surrounds a harder inner core 38 from which a point 40 is constantly formed. The hard outer shell 36 may be composed of any known hard metal or material that is easily formed. The harder inner core 38 may be composed by any other hard material such as carbide steel. Also illustrated in FIG. 8 is retraction channel 42 that, when digging tooth 14 is completely inserted in female socket receiving means 26, extends just above the top of the substantially solid portion 24 of removeable cap means 12. As a result, any forked tool such as a crowbar or a pair of pliers may be utilized to grasp digging tooth 14 to remove it quickly and easily.

Figure 9:
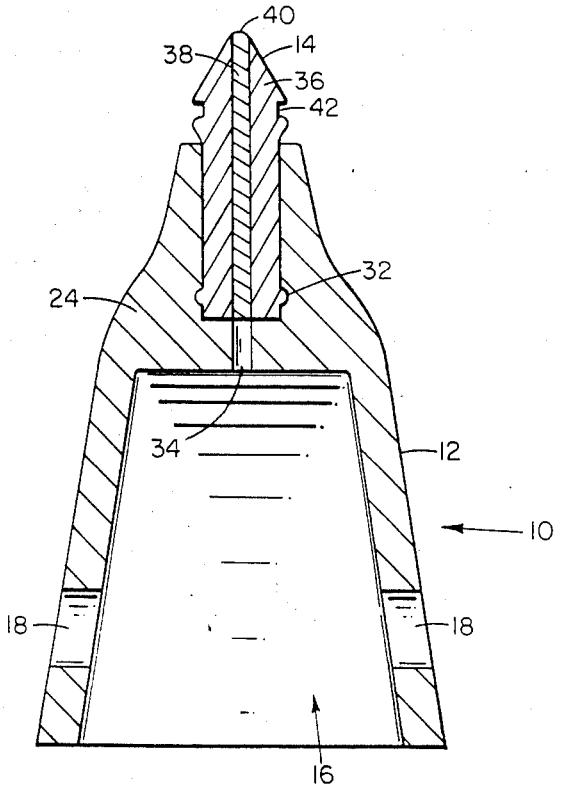
FIG. 9 is a cross sectional view of the cap means and the digging tooth inserted therein.

FIG. 9 is a cross sectional view of device 10 showing digging tooth 14 inserted in female socket 26.

In operation then, removeable cap means 12 is placed over and conformed to fit with any shank of any "bucket" mounted to the powered arm of an excavator or other such earth moving device. Removeable cap means 12 is held in place by utilization of a pair of oppositely positioned retaining holes 18 which, in conjunction with retaining pin 20, is designed to attach removeable cap 12 to the available shank. Cotter pins 22 in retaining pin 20 are designed to prevent the inadvertent removal of retaining pin 20 and loss of removeable cap 12 during operation. It is obvious that substantially hollow portion 16 of removeable cap 12 can be conformed to fit any available shank. Additionally, removeable cap 12 may be conformed to accept any desired attachment means from said shank other than oppositely positioned retaining holes 18.

Referring to FIG. 2, removeable cap means 12 is shown in cross section thereby illustrating substantially solid portion 24 at the tip of removeable cap 12. This solid portion 24 provides mass and assists in the digging mechanism to some degree. Primarily, however, substantially solid portion 24 provides the necessary mass to provide a base and support for female socket receiving means 26. The socket means is designed and shaped to conform with the cylindrically shaped digging tooth 14. Female socket receiving means 26 is composed of a cylincrically shaped chamber 28 and outer race channel 30. By means of the conformed cylindrical shape, female socket receiving means 26 snugly surrounds digging tooth 14 thereby eliminating the primary cause of failure of most prior art teeth. That is, most teeth in the prior art are attached to the outside of cap 12 and thereby are exposed to severe pressure and shear forces that cause the tooth to pry away from an ordinary cap. In this instance, similar to teeth in a human being, the digging tooth 14 is securely inserted in female socket 26 and surrounded by conforming cylindrically shaped chamber 28. Outer race channel 30 enables ball bearings and inner race means 32 on digging tooth 14 to secure digging tooth 14 in socket 26. Additionally, because of inner race means 32 being constructed with ball bearings, or the like, digging tooth 14 is allowed to revolve within cylindrically shaped chamber 28. This enables digging tooth 14 to rotate perpendicularly to the motion of the excavating bucket. As a result, much of the shear forces applied to the digging teeth are reduced. Additionally, as a result of the rotation of digging tooth 14 within female socket 26, digging tooth 14 is constantly wearing on different portions of the hard outer shell 36. This in turn, results in a constant "self sharpening" of digging tooth 14. Because digging tooth 14 has a harder inner core 38, the constant erosion of the hard outer shell 36 results in the continuous provision of a digging point 40.

By way of the present invention, the replacement of digging tooth 14 is greatly simplified because of the fact that cap means 12 may be left in place the majority of the time. This is unlike other devices which require the removal of the entire cap means that covers the shank of excavating buckets in order to replace teeth. The insertion of digging tooth 14 into female socket 26 is a simple matter and takes only a few seconds to accomplish. Removal of digging tooth 14 is accomplished in one of two ways. The preferred way is through utilization of retraction channel 42 on digging tooth 14 whereby a crowbar, plier or any forked tool is slipped into retraction channel 42 and the tooth pried from female socket 26. Should digging tooth 14 break off below retraction channel 42 or should digging tooth 14 not be removeable through use of retaction channel 42 for any reason, there is an alternative method for removal that is provided. Removal in this instance would require the removal of cap means 12 and the insertion of a steel rod or some hard push rod through ejection hole 42 in the base of substantially hollow portion 16 of cap means 12. Ejection hole 34 is connected with the cylindrically shaped chamber 28 and enables a push rod to force the portion of digging tooth 14 from female socket 26.

While the digging tooth system of the present invention has been disclosed in connection with only one removeable cap means 12, it should be appreciated that a plurality of removeable cap means 12 could be inserted side by side on any number of available shanks located on an excavator or other machine. Additionally, as evidenced in the drawings, one or more digging teeth 14 can be provided in removeable cap means 12. As a result, the present invention provides an improved interiorly located, rotating, self sharpening, replaceable digging tooth which can be easily assembled and replaced. The design of the device makes it much more resistant to shear stresses and enables digging tooth 14 to be functional much longer than prior art teeth. Further, because of the self sharpening properties of the device, its long lasting qualities are extended even further. Thus, the digging tooth mechanism of the present invention has an important advantage of cost savings due to reduced down time and limiting the need for replacement parts.

While the present invention has been disclosed in connection with the preferred embodiment thereof, it should be understood that there may be other embodiments which fall within the spirit and scope of the invention as defined by the following claims.

What is claimed is:

1. A method of providing an interiorly located, rotating, self sharpening replaceable digging tooth comprising the steps of:

a. attaching a removeable cap means to a shank on an excavating machine with a lower half that is a substantially hollow portion so that said hollow portion just conforms to said shank;

b. providing a pair of oppositely positioned retaining holes in said cap means that conform in size and location to retaining holes in said shank;

c. providing a replaceable retaining pin conformed to said retaining holes for holding said cap on said shank;

d. constructing a substantially solid portion of said cap means above said hollow portion that provides a base and support for a female socket receiving means;

e. mounting a replaceable bullet shaped tooth cylinder within one end of said cap means;

f. constructing said tooth cylinder with a flat base and a pointed end and with a hard outer surface and a harder inner core from which a point is formed;

g. locating an inner race means around said flat base end of said tooth cylinder for rotatably securing said cylinder in said socket receiving means;

h. providing a retraction channel means near said pointed end of said tooth cylinder so that said tooth cylinder can be removed from said socket receiving means for repair and replacement;

i. forming said female socket receiving means with a cylindrically shaped chamber conformed to just receive said tooth cylinder in said cap means for receiving and retaining said tooth cylinder and allowing said tooth cylinder to rotate therein so that said tooth cylinder is self sharpening;

j. constructing an outer race means near the bottom of said socket chamber conformed to receive said inner race means; and k. constructing an ejection hole in the bottom of said socket chamber that connects with said hollow portion of said cap means so that said tooth cylinder may be ejected from said socket chamber of said cap means by pushing said tooth cylinder by way of said hollow portion and said ejection hole.

2. The method of providing a tooth cylinder of claim 1 wherein a plurality of female socket receiving means are constructed in said cap means.

3. The method of providing a tooth cylinder of claim 2 wherein a corresponding plurality of said replaceable teeth are mounted within said plurality of said female socket receiving means.

4. An interiorly located, rotating, self sharpening, replaceable digging tooth comprising:

a. a removable cap means that fits over and is attached to a shank on a digging means;

b. a replaceable tooth mounted in one and of said cap means;

c. a female socket receiving means in said cap means for receiving and retaining said tooth and allowing it to rotate therein so that said tooth rotates as used and is thereby self sharpening;

d. a lower half of said cap means with a substantially hollow portion so that said hollow portion conforms to said shank;

e. a pair of oppositely positioned retaining holes that conform in size and location to retaining holes in said shank;

f. a removable retaining means conformed to said retaining holes for holding said cap on said shank;

g. a substantially solid portion above said hollow portion that provides a base and support for said female socket receiving means;

h. a shaped cylinder with a base and with a pointed end and with a hard outer surface and a harder inner core from which a point is formed;

i. an inner race means for rotatably securing said cylinder in said socket receiving means, located around said base of said cylinder;

j. a retraction channel means located near said pointed end of said cylinder so that said cylinder can be removed from said socket receiving means for repair and replacement;

k. a cylindrically shaped chamber conformed to just receive said tooth;

l. an outer race means near the bottom of said chamber conformed to receive said inner race means and thereby retain said tooth and enable said tooth to rotate freely in said chamber; and m. an ejection hole in the bottom of said chamber that connects with said hollow portion of said cap means so that said tooth may be ejected from said chamber of said cap means by pushing said base of said tooth by way of said hollow portion and said ejection hole.

5. The digging tooth of claim 4 wherein there are a plurality of said female socket receiving means in said cap means.

6. The digging tooth of claim 5 wherein there are a corresponding plurality of said replaceable teeth mounted within said plurality of said female socket receiving means.

7. An interiorly located, rotating, self sharpening, replaceable digging tooth comprising:

a. a removeable cap means that fits over and is attached to a shank on an excavating machine;

b. a lower half of said cap means with a substantially hollow portion so that said hollow portion conforms to said shank;

c. a pair of oppositely positioned retaining holes in said cap means that conform in size and location to retaining holes in said shank;

d. a removeable retaining pin conformed to said retaining holes for holding said cap means on said shank;

e. a substantially solid portion of said cap means above said hollow portion that provides a base and support for a female socket receiving means;

f. a replaceable bullet shaped tooth cylinder mounted within one end of said cap means with a flat base and a pointed end and with a hard outer surface and a harder inner core from which a point is formed;

g. an inner race means for rotatably securing said cylinder, in said socket receiving means, located around said flat base of said cylinder;

h. a retraction channel means located near said pointed end of said cylinder so that said cylinder can be removed from said socket receiving means for repair and replacement; i. said female socket receiving means in said cap means with a cylindrically shaped chamber for receiving and retaining said tooth cylinder and allowing it to rotate therein so that said tooth cylinder is self sharpening;

j. an outer race means near the bottom of said socket chamber conformed to receive said inner race means of said tooth cylinder and thereby retaining said tooth cylinder and enabling said tooth cylinder to rotate freely in said socket chamber; and k. an ejection hole in the bottom of said socket chamber that connects with said hollow portion of said cap means so that said tooth cylinder may be ejected from said chamber of said cap means by pushing said tooth cylinder by way of said hollow portion and said ejection hole.

8. The digging tooth of claim 7 wherein there are a plurality of said female socket receiving means in said cap means.

9. The digging tooth of claim 8 wherein there are a corresponding plurality of said replaceable teeth mounted within said plurality of said female socket receiving means.

* * * * *